US008951166B2

(12) United States Patent
Bae

(10) Patent No.: US 8,951,166 B2
(45) Date of Patent: Feb. 10, 2015

(54) ARTIFICIAL CLIMBING WALL PANEL, BRACKET FOR ARTIFICIAL CLIMBING WALL PANEL AND ARTIFICIAL CLIMBING WALL STRUCTURE USING THE SAME

(75) Inventor: Bong Il Bae, Seoul (KR)

(73) Assignee: Discovery Climbing System Co., Ltd. (KR)

( * ) Notice: Subject to any disclaimer, the term of this patent is extended or adjusted under 35 U.S.C. 154(b) by 455 days.

(21) Appl. No.: 13/176,585

(22) Filed: Jul. 5, 2011

(65) Prior Publication Data

US 2012/0178588 A1 Jul. 12, 2012

(30) Foreign Application Priority Data

Jul. 6, 2010 (KR) ..... 10-2010-0064734

(51) Int. Cl.
*A63B 9/00* (2006.01)
*A63B 69/00* (2006.01)

(52) U.S. Cl.
CPC ..... *A63B 69/0048* (2013.01)
USPC ..... 482/37; 482/35

(58) Field of Classification Search
CPC .... A63B 9/00; A63B 69/0048; A63B 21/072; A63B 21/0728; A62B 22/04
USPC ..... 482/23, 35–39
See application file for complete search history.

(56) References Cited

U.S. PATENT DOCUMENTS

| | | | | |
|---|---|---|---|---|
| 4,097,043 | A * | 6/1978 | Rudy | 482/35 |
| 5,254,058 | A * | 10/1993 | Savigny | 482/37 |
| 6,514,178 | B2 * | 2/2003 | Vettori | 482/37 |
| 6,544,145 | B2 * | 4/2003 | Yoshida et al. | 482/35 |
| 7,572,207 | B2 * | 8/2009 | Postma | 482/37 |
| 2002/0169052 | A1 * | 11/2002 | Godsey | 482/37 |

FOREIGN PATENT DOCUMENTS

JP 2007-222202 9/2007

OTHER PUBLICATIONS

STIC Machine Translation of JP2007-222202, Mar. 12, 2014.*

* cited by examiner

*Primary Examiner* — Loan H Thanh
*Assistant Examiner* — Nyca T Nguyen
(74) *Attorney, Agent, or Firm* — The Belles Group, P.C.

(57) ABSTRACT

Disclosed is a triangular artificial climbing wall panel according to the embodiment. The longest side of one triangular artificial climbing wall panel is in contact with the longest side of another triangular artificial climbing wall panel adjacent to the one triangular artificial climbing wall panel, and the two artificial climbing wall panels are disposed in the XYZ space. Four sides except the two longest sides out of six sides of the two triangular artificial climbing wall panels form a rectangle as viewed perpendicular to an XY plane.

20 Claims, 9 Drawing Sheets

ARTIFICIAL CLIMBING WALL PANEL, BRACKET FOR ARTIFICIAL CLIMBING WALL PANEL AND ARTIFICIAL CLIMBING WALL STRUCTURE USING THE SAME

CROSS-REFERENCE TO RELATED APPLICATIONS

This application claims priority under 35 U.S.C. §119 to Korean Patent Application No. 10-2010-0064734 filed on Jul. 6, 2010, the entirety of which is hereby incorporated by reference.

FIELD OF THE INVENTION

The present invention relates to an artificial climbing wall panel, a bracket for the artificial climbing wall panel and an artificial climbing wall structure using the same, and more particularly to an artificial climbing wall panel that is formed in the form of a module and is used to make an artificial climbing wall structure by combining the modules, and more particularly to a bracket for the artificial climbing wall panel, and more particularly to an artificial climbing wall structure that is formed by combining the artificial climbing wall panels and is used as a landscaping wall, a climbing structure and an interior structure.

BACKGROUND OF THE INVENTION

An artificial climbing wall is used for the variety of purposes, for example, a sports climbing and a simple wall for decoration, and the like. The sports climbing is to climb a prefabricated artificial climbing wall that is installed indoors or outdoors. The sports climbing allows modern busy people to save the time required for arriving at natural rock walls and ensures people to safely enjoy climbing at a low cost without danger of natural rock-climbing.

The sports climbing is to move by using only hand and foot along the wall having an artificial hold (a projection to hold by hand) attached to fiberglass reinforced plastic (FRP) or a huge plywood reminding us of building walls or rock walls. Originally, the sports climbing was well-known as a training for professional climbers, however, is now rapidly spread to the public who enjoy leisure sports.

Various artificial climbing walls have been designed for indoor sports climbing practice. A conventional prefabricated artificial climbing wall is configured by coupling numbers of quadrangular blocks shaped like a rock to the wall. A screw coupling method using bolts and nuts is mainly used as a method for coupling the block to the wall.

SUMMARY OF THE INVENTION

One aspect of the present invention is a triangular artificial climbing wall panel. The longest side of one triangular artificial climbing wall panel is in contact with the longest side of another triangular artificial climbing wall panel adjacent to the one triangular artificial climbing wall panel, and the two artificial climbing wall panels are disposed in the XYZ space. Four sides except the two longest sides out of six sides of the two triangular artificial climbing wall panels form a rectangle as viewed perpendicular to an XY plane.

Another aspect of the present invention is triangular artificial climbing wall panel. The longest side of one triangular artificial climbing wall panel is in contact with the longest side of another triangular artificial climbing wall panel adjacent to the one triangular artificial climbing wall panel, and the two artificial climbing wall panels are disposed in the XYZ space. Z-components of the vertices of both ends of the longest sides are equal to each other.

Further another aspect of the present invention is an artificial climbing wall bracket including a pin being located at the central portion thereof and allowing the bracket to be folded and unfolded, and a plate extending outward in both directions of the pin. Holes are formed in the plate and are directly coupled with the artificial climbing wall panel.

Yet another aspect of the present invention is an artificial climbing wall bracket having a triangular plate shape and disks including holes which are formed around the two vertices of one side of the triangular plate shape and allow the bracket to be coupled to another bracket.

Still another aspect of the present invention is an artificial climbing wall bracket having a quadrangular plate shape and holes formed around both vertices of the quadrangular plate shape. A circular third disk which is perpendicular to the plate and has a hole formed therein is attached to a side connecting the other two vertices.

DETAILED DESCRIPTION

Figure 1:
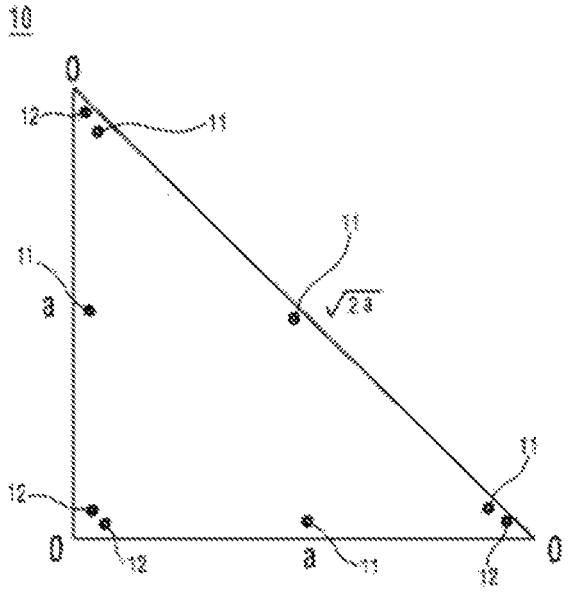
FIG. 1 shows a first embodiment of a triangular artificial climbing wall panel 10.

In description of embodiments, if there is no particular criterion for up, down, right, left, top and bottom, drawings are regarded as the criterion. An X-axis direction can be used as a right or left direction. A Y-direction can be used as a top or bottom direction. In the description of the present invention, the X and Y axes and a Z axis are based on the coordinate axis shown in the drawings. An XYZ space is defined as a 3-dimensional space including an XYZ axis shown in the drawings. Therefore, the term of the XYZ space can be used as the 3-dimensional space. In the drawings, a size of each component or a certain part constituting the component is magnified, omitted or schematically shown for the purpose of convenience and clearness of description. The size of each component does not necessarily mean its actual size.

Hereafter, a triangular artificial climbing wall panel 10 and an artificial climbing wall structure, 1 according to an embodiment will be described with reference to FIGS. 1 to 15.

Figure 2:
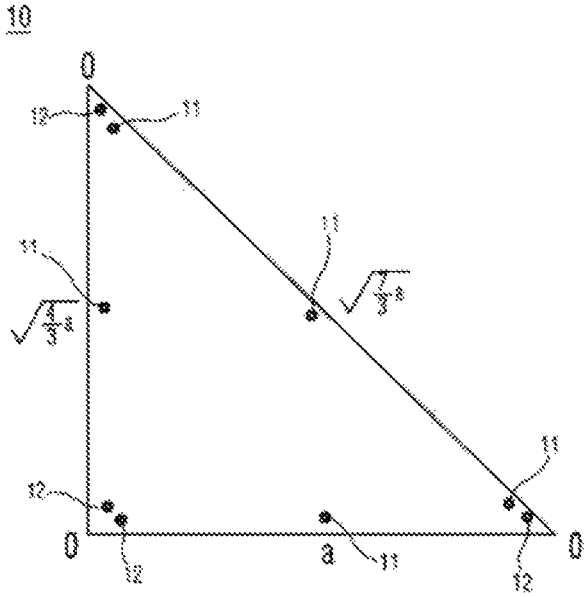
FIG. 2 shows a second embodiment of the triangular artificial climbing wall panel 10.

FIG. 1 shows a first embodiment of a triangular artificial climbing wall panel 10. FIG. 2 shows a second embodiment of the triangular artificial climbing wall panel 10.

Referring to FIGS. 1 and 2, three sides shown in the first embodiment are "a", "a" and "$\sqrt{2}a$". The value of the "a" is changed according to the size of the artificial climbing wall panel 10 designed to be manufactured. The three values of "0, 0 and 0" located near vertices represent relative values of the Z-components of the coordinates of the vertices of the triangular artificial climbing wall panel 10. The relative value of the Z-component of the coordinates is not an absolute value but is a relative height difference between the three vertices. For example, in the XYZ plane in the first embodiment, since the Z-components of the three vertices are "0, 0 and 0", there is no difference between the three Z-components. This means that the Z-components of the three points (vertices) are the same as each other. Accordingly, what is important is not the absolute value itself of each of three vertices but how much they are different from each other. For example, in the first embodiment, a case where the Z-components of the three vertices are "0, 0 and 0" is completely equal to a case where the Z-components of the three vertices are "1, 1 and 1".

In the second embodiment, three sides are "a", $$\text{“}\sqrt{\frac{4}{3}a}\text{” and “}\sqrt{\frac{7}{3}a}\text{”.}$$

The value of the "a" is changed according to the size of the artificial climbing wall panel 10 to be manufactured. The three values of "0, 0 and H" located near vertices represent relative values of the Z-components of the coordinates of the vertices of the triangular artificial climbing wall panel 10. The relative value of the Z-component of the coordinates is not an absolute value but is a relative height difference between the three vertices. For example, in the XYZ plane in the second embodiment, since the Z-components of the three vertices are "0, 0 and H", there is no difference between the two Z-components and one Z-component is "H". This means that the one Z-component is greater than the rest of the two Z-components by as much as "H". Accordingly, what is important is not the absolute value itself of each of three vertices but how much they are different from each other. For example, in the second embodiment, a case where the Z-components of the three vertices are "0, 0 and H" is completely equal to a case where the Z-components of the three vertices are "H, H and 2H".

Various embodiments other than the first and the second embodiments can be provided to have various three sides and various relative values of the Z-components of the vertices. Such embodiments will be summarized in a simple table. First, the second embodiment will be taken as an example for description. Three sides are "a", $$\text{“}\sqrt{\frac{4}{3}a}\text{” and “}\sqrt{\frac{7}{3}a}\text{”.}$$

A relative value of the Z-component of the coordinates of a vertex between the "a" and $$\text{“}\sqrt{\frac{4}{3}a}\text{”}$$

and is 0. A relative value of the Z-component of the coordinates of a vertex between the $$\text{“}\sqrt{\frac{4}{3}a}\text{” and “}\sqrt{\frac{7}{3}a}\text{”.}$$

is "H". A relative value of the Z-component of the coordinates of a vertex between the $$\text{“}\sqrt{\frac{7}{3}a}\text{”}$$

and "a" is 0. In the table below, the three sides of the triangular artificial climbing wall panel 10 are represented by a first side, a second side and a third side respectively. The third side is the longest and the others of two sides are the first side and the second side respectively. The table also shows that a length ratio of the three sides and the relative value of the Z-component of the coordinates of each of the vertices. As described above, the value of the "a" for representing the length of each side is changed according to the size of the artificial climbing wall panel 10 designed to be manufactured. Once the value of the "a" is determined, the "a" has the determined value from the first embodiment to the eleventh embodiment. The following table I shows numerical values related to the triangular artificial climbing wall panels 10 according to the first embodiment to the eleventh embodiment.

TABLE 1

| | length of the first side | length of the second side | length of the third side | relative values of the Z-components of the coordinates of the vertex between the first and the second sides | relative values of the Z-components of the coordinates of the vertex between the second and the third sides | relative values of the Z-components of the coordinates of the vertex between the third and the first sides |
|---|---|---|---|---|---|---|
| first embodiment | a | a | | 0 | 0 | 0 |

TABLE 1-continued

| | length of the first side | length of the second side | length of the third side | relative values of the Z-components of the coordinates of the vertex between the first and the second sides | relative values of the Z-components of the coordinates of the vertex between the second and the third sides | relative values of the Z-components of the coordinates of the vertex between the third and the first sides |
|---|---|---|---|---|---|---|
| second embodiment | $\sqrt{\frac{4}{3}a}$ | a | $\sqrt{\frac{7}{3}a}$ | 0 | 0 | H |
| third embodiment | $\sqrt{\frac{5}{3}a}$ | a | $\sqrt{\frac{7}{3}a}$ | 0 | 0 | 2H |
| fourth embodiment | $\sqrt{2a}$ | a | $\sqrt{3a}$ | 0 | 0 | 3H |
| fifth embodiment | $\sqrt{\frac{4}{3}a}$ | $\sqrt{\frac{4}{3}a}$ | $\sqrt{2a}$ | H | 0 | 0 |
| sixth embodiment | $\sqrt{\frac{5}{3}a}$ | $\sqrt{\frac{5}{3}a}$ | $\sqrt{2a}$ | 2H | 0 | 0 |
| seven embodiment | $\sqrt{2a}$ | $\sqrt{2a}$ | $\sqrt{2a}$ | 0 | 0 | 3H |
| eight embodiment | $\sqrt{\frac{4}{3}a}$ | $\sqrt{\frac{4}{3}a}$ | $\sqrt{\frac{8}{3}a}$ | H | 2H | 0 |
| ninth embodiment | $\sqrt{\frac{4}{3}a}$ | $\sqrt{\frac{4}{3}a}$ | $\sqrt{\frac{7}{3}a}$ | 2H | H | 0 |
| tenth embodiment | $\sqrt{\frac{4}{3}a}$ | $\sqrt{2a}$ | $\sqrt{\frac{8}{3}a}$ | 0 | 3H | H |
| eleventh embodiment | $\sqrt{2a}$ | $\sqrt{\frac{5}{3}a}$ | $\sqrt{\frac{7}{3}a}$ | 0 | 2H | 3H |

The artificial climbing wall structure 1 to be described later is manufactured by combining the artificial climbing wall panels 10 of the first to the eleventh embodiments.

In the first and the second embodiments, each side of the triangular artificial climbing wall panel 10 includes at least one bracket coupling hole. The drawings show that each side includes three bracket coupling holes 11, 12. A base bracket 20 and an adjustable bracket 50 are coupled to the bracket coupling hole. The base bracket 20 and the adjustable bracket 50 will be described later.

Figure 3:
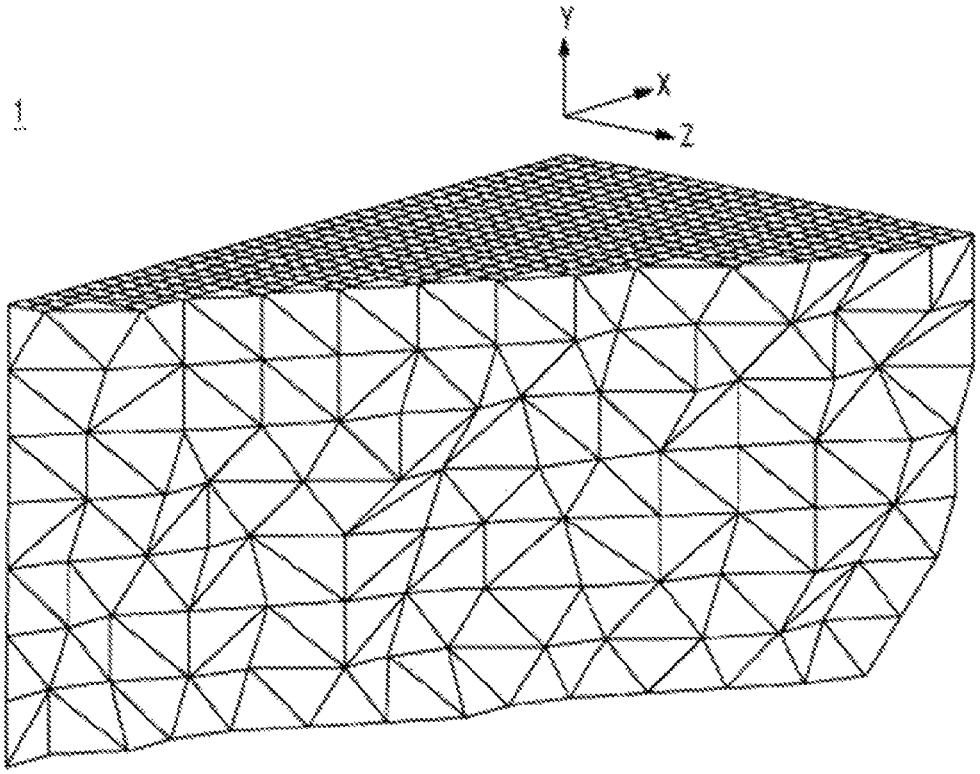
FIG. 3 is a mimetic diagram showing an artificial climbing wall structure 1 formed in an XYZ space by combining the triangular artificial climbing wall panels 10 in the XYZ space.

FIG. 3 is a mimetic diagram showing an artificial climbing wall structure 1 formed in an XYZ space by combining the triangular artificial climbing wall panels 10 in the XYZ space. The longest side (the third side) of one triangular artificial climbing wall panel 10 is in contact with the longest side (the third side) of another triangular artificial climbing wall panel 10. When the longest sides of the two triangular artificial climbing wall panels 10 are in contact with each other, the two triangles form a quadrangle as viewed perpendicular to an XY plane, and more accurately speaking, form a rectangle. Particularly, in FIG. 3, the two triangles form a square. When the two triangles form a square, the highest degree of freedom can be obtained in the arrangement and combination of the triangular artificial climbing wall panels 10. However, it does not mean that the aforementioned rectangle and square have an angle of 90° between two adjacent sides thereof. There may be a slight error. Besides, the angle between two adjacent sides may be an acute angle somewhat less than 90° or may be an obtuse angle somewhat greater than 90°. In this case, when the two triangular artificial climbing wall panels 10 are in contact with each other, they have a shape of a parallelogram that is similar to the rectangle and the square. As such, when the two triangular artificial climbing wall panels 10 form the parallelogram that is similar to the rectangle and the square, it is regarded that they form the rectangle and the square.

When the artificial climbing wall structure 1 shown in FIG. 3 is viewed perpendicular to the XY plane, it looks like that square unit modules formed by combining the two triangles are connected with each other from side to side along the X-axis and up and down along the Y-axis. In the first to the eleventh embodiments, a right angled triangular artificial climbing wall panel 10 occupies nothing but a portion of the artificial climbing wall structure 1. However, when the artificial climbing wall panels 10 are, as shown in FIG. 3, arranged on the XYZ plane and form the artificial climbing wall structure 1, all of the triangular artificial climbing wall panels 10 look like right angled triangles as viewed perpendicular to the XY plane. One triangular artificial climbing wall panel 10 having the longest side in contact with the longest side of another artificial climbing wall panel 10 looks like a right angled triangle that is congruent with the triangle of the another triangular artificial climbing wall panel 10. As a result, the two right angled triangles form a square. That is, four sides except the two longest sides out of six sides of the two right angled triangular artificial climbing wall panels 10 form a square. However, when the three sides of the triangular artificial climbing wall panel 10 are the same as each other, four sides except the two contacting sides form a quadrangle. When the triangular artificial climbing wall panels 10 has two sides longer than the other, two longer sides and two shorter sides except two longer contacting sides form a quadrangle. In the artificial climbing wall structure 1 shown in FIG. 3, while the case where the two triangular artificial climbing wall panels 10 form a square as viewed perpendicular to the XY plane has been described in the foregoing description, the two triangular artificial climbing wall panels 10 can form a rectangle. In a case where the two triangular artificial climbing wall panels 10 form a rectangle, it can be also easily understood by those skilled in the art that the length of each side and the relative value of the Z-component of each vertex of the triangular artificial climbing wall panel 10 of the first to the eleventh embodiments, which has been taken above as an example, are changed.

Figure 4:
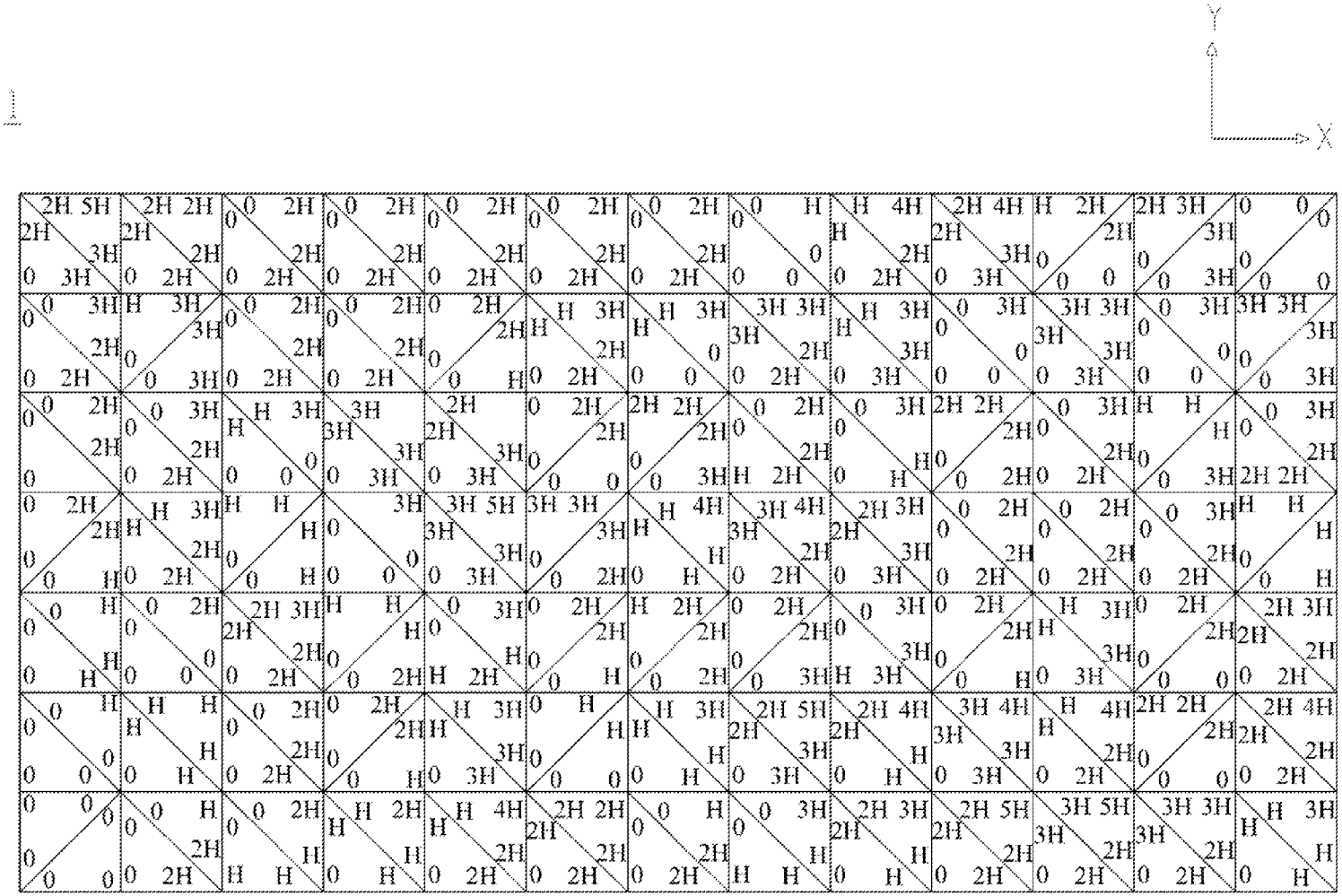
FIG. 4 shows a relative value of a Z-component of the coordinates of each vertex in the triangular artificial climbing wall panel 10 forming the artificial climbing wall structure 1 of FIG. 3.

FIG. 4 shows a relative value of a Z-component of the coordinates of each vertex in the triangular artificial climbing wall panel 10 forming the artificial climbing wall structure 1 of FIG. 3. Referring to FIG. 4, when the artificial climbing wall structure 1 is viewed perpendicular to the XY plane, it can be more clearly seen that each triangular artificial climbing wall panel 10 forms a right angled triangle.

It is assumed that the X-axis direction is right or left direction and the Y-axis direction is up or down direction. Here, in the second artificial climbing wall panel 10 from the left of the uppermost end, the relative values of the Z-components of the right vertices are 5H and 3H. In the artificial climbing wall panel 10 on the just right of the aforementioned second artificial climbing wall panel 10, the relative values of the Z-components of the left vertices are 2H and 0. In the Z-components of the right vertices of the second artificial climbing wall panel 10 from the left of the uppermost end, 5H is larger than 3H by 2H. In the Z-components of the left vertices of the artificial climbing wall panel 10 on the just right of the aforementioned second artificial climbing wall panel 10, 2H is larger than 0 by 2H. That is, in the two contacting sides of the two artificial climbing wall panels 10, the Z-components of the upper vertices are larger than those of the lower vertices by 2H. This means that the two contacting sides are connected with each other without a height difference or a level difference. In the foregoing, a specific artificial climbing wall panel 10 has been described. However, two contacting sides of all of the artificial climbing wall panels 10 forming the artificial climbing wall structure 1 of FIG. 4 are smoothly connected with each other without a height difference or a level difference. Moreover, in not only the artificial climbing wall structure 1 shown in FIG. 4 but also all the artificial climbing wall structures 1 which can be formed through the combination of the artificial climbing wall panels 10, two contacting sides of all of the artificial climbing wall panels 10 forming such an artificial climbing wall structure 1 are connected with each other without a height difference or a level difference. This means that the Z-components of the vertices of both ends of the two contacting sides are equal to each other.

In a conventional artificial climbing wall structure formed by combining rectangular unit artificial climbing wall modules, when the relative value of the Z-component of the coordinates is one of 0, H and 2H, it was possible to relatively easily form the artificial climbing wall structure. However, since the relative value of the Z-component of the coordinates should be greater than 3H in order to form an artificial climbing wall structure having a steep incline like natural rock walls, it is not possible to form the artificial climbing wall structure having a steep incline by using the rectangular artificial climbing wall module. About 40 kinds of the rectangular artificial climbing wall modules are required so as to allow the relative value of the Z-component of the coordinates to be even 2H. Moreover, so many kinds of the modules are required so as to allow the relative value of the Z-component of the coordinates to be greater than 3H. In fact, in this case, the artificial climbing wall structure can never be formed by using the rectangular artificial climbing wall modules. In other words, an artificial climbing wall structure having a strongly curved surface can be formed not by couple of the modules but by make-to-order. However, as described above, the triangular artificial climbing wall panel 10 according to the embodiment of the present invention can be used in the form of a module even when the relative value of the Z-component of the coordinates is greater than 3H.

In addition, since the conventional artificial climbing wall structure formed by combining the rectangular unit artificial climbing wall modules has a rugged surface and little flat portion in order to appear to have a three-dimensional effect like natural rocks, it is not easy to securely attach and fix an artificial hold to the artificial climbing wall module. Since the artificial holds are mass-manufactured with a certain size rather than made to order to confirm to a specific wall surface, a surface contacting with the artificial climbing wall structure 1 is commonly made flat, so that the artificial hold is fixed on the rugged surface of the artificial climbing wall structure 1 by fastening a bolt with a strong force. Therefore, the artificial climbing wall module is badly affected and the artificial hold is prone to become loose from the artificial climbing wall structure 1 in a certain period of time after being fixed. However, the artificial climbing wall panel 10 according to the embodiment has a flat triangular shape, so that it is possible to strongly attach and fix the artificial hold to the artificial climbing wall panel 10.

Recently, demand for a panel hold as well as an artificial hold having an about fist size is increasing. The panel hold corresponds to an artificial climbing wall panel itself functioning as an artificial hold. While importance was attached to the formation itself of the artificial climbing wall in the past, the requirements for an artificial climbing wall structure allowing variously sized holds to be easily set are recently increasing. In order to satisfactorily meet the requirements, the surface shape of the artificial climbing wall module or the artificial climbing wall panel is not necessarily complicated and can be simple. It is enough as long as the artificial climbing wall modules or the artificial climbing wall panels are coupled at various angles. Additionally, a huge panel hold can provide artistry, voluminousness and the feel of real natural rocks to the artificial climbing wall structure formed by coupling the artificial climbing wall panels having the simple surfaces.

The conventional rectangular artificial climbing wall module has the aforementioned problem in fixing even a small artificial hold, so that it is practically impossible to apply the panel hold to the conventional rectangular artificial climbing wall module. However, the artificial climbing wall panel 10 according to the embodiment has a triangular shape and one artificial climbing wall panel 10 is completely flat. Therefore, there is no problem in applying the panel hold.

Figure 5:
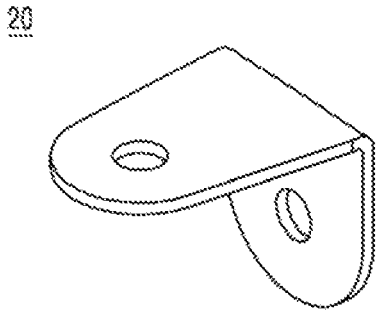
FIG. 5 is a perspective view of a basic bracket 20.
Figure 6:
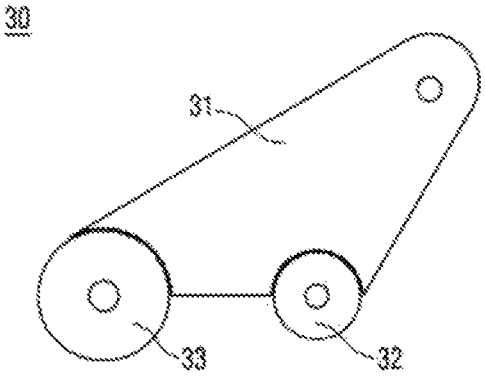
FIG. 6 is a view showing an embodiment of a vertical bracket 30.
Figure 7:
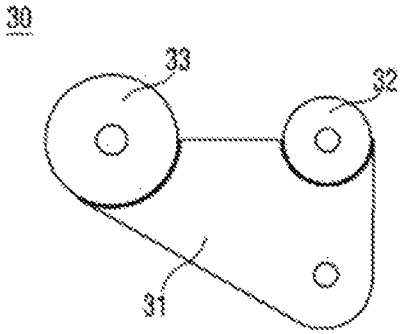
FIG. 7 is a view showing another embodiment of the vertical bracket 30.
Figure 8:
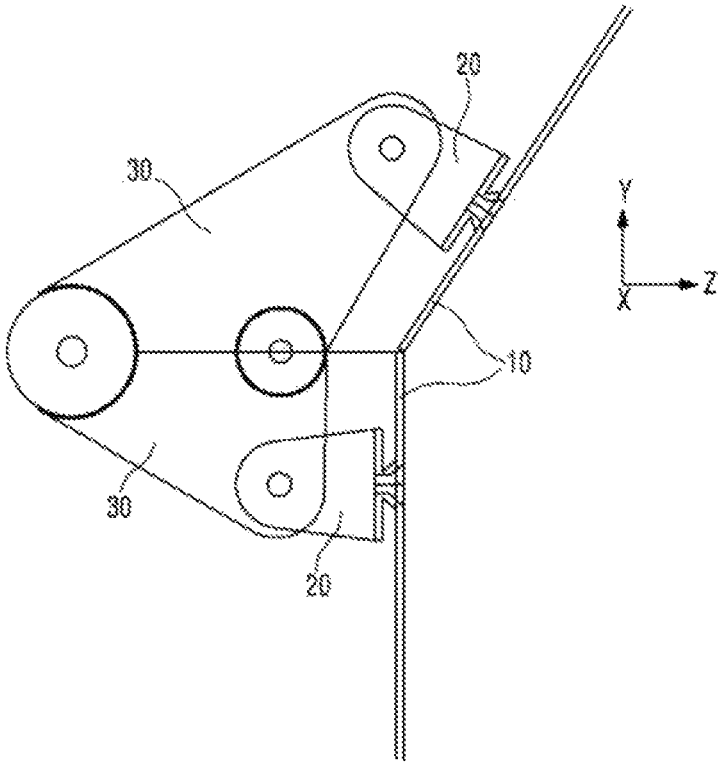
FIG. 8 is a state diagram showing adjacent artificial climbing wall panels 10 coupled to each other by the vertical bracket 30.
Figure 9:
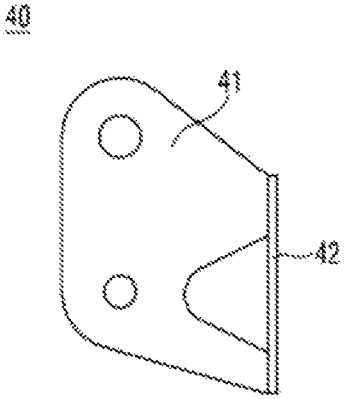
FIG. 9 is a front view of an embodiment of a horizontal bracket 40.
Figure 10:
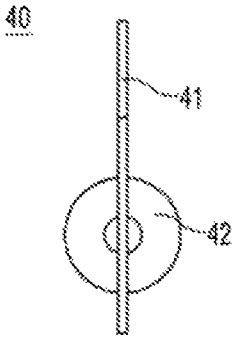
FIG. 10 is a side view of the horizontal bracket 40 of FIG. 9.
Figure 11:
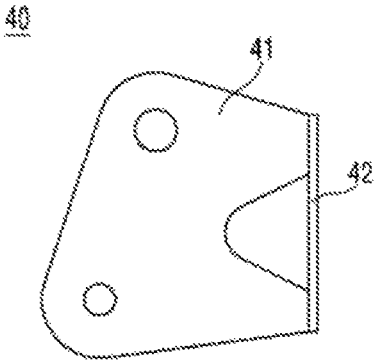
FIG. 11 is a front view of another embodiment of the horizontal bracket 40.
Figure 12:
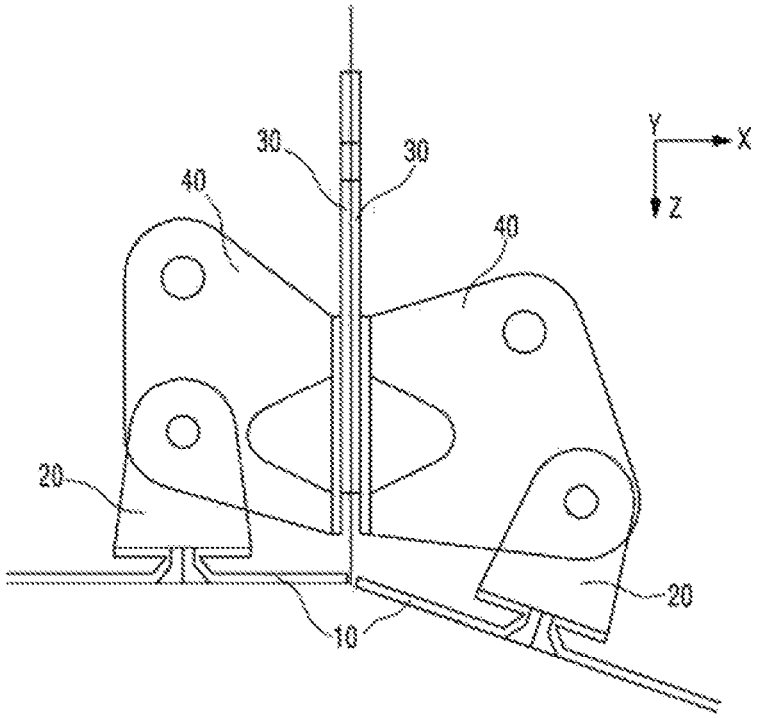
FIG. 12 is a state diagram showing that adjacent artificial climbing wall panels 10 have been coupled to each other by the horizontal bracket 40.
Figure 13:
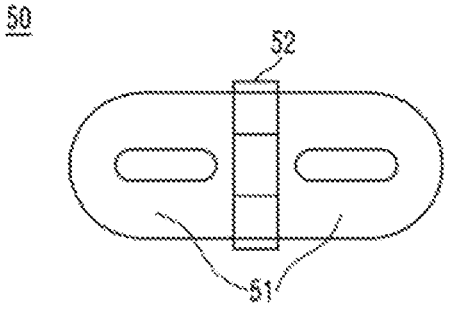
FIG. 13 is a plan view of an adjustable bracket 50.
Figure 14:
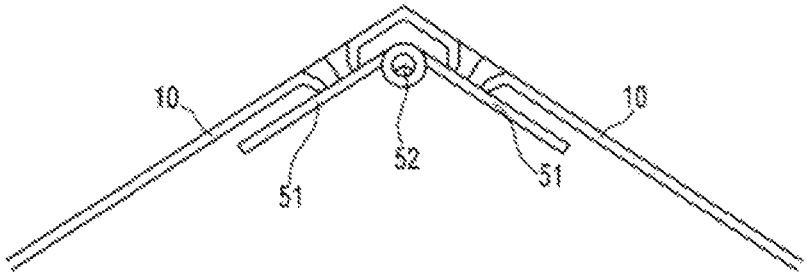
FIG. 14 is a state diagram showing that adjacent artificial climbing wall panels 10 have been coupled to each other by the adjustable bracket 50.
Figure 15:
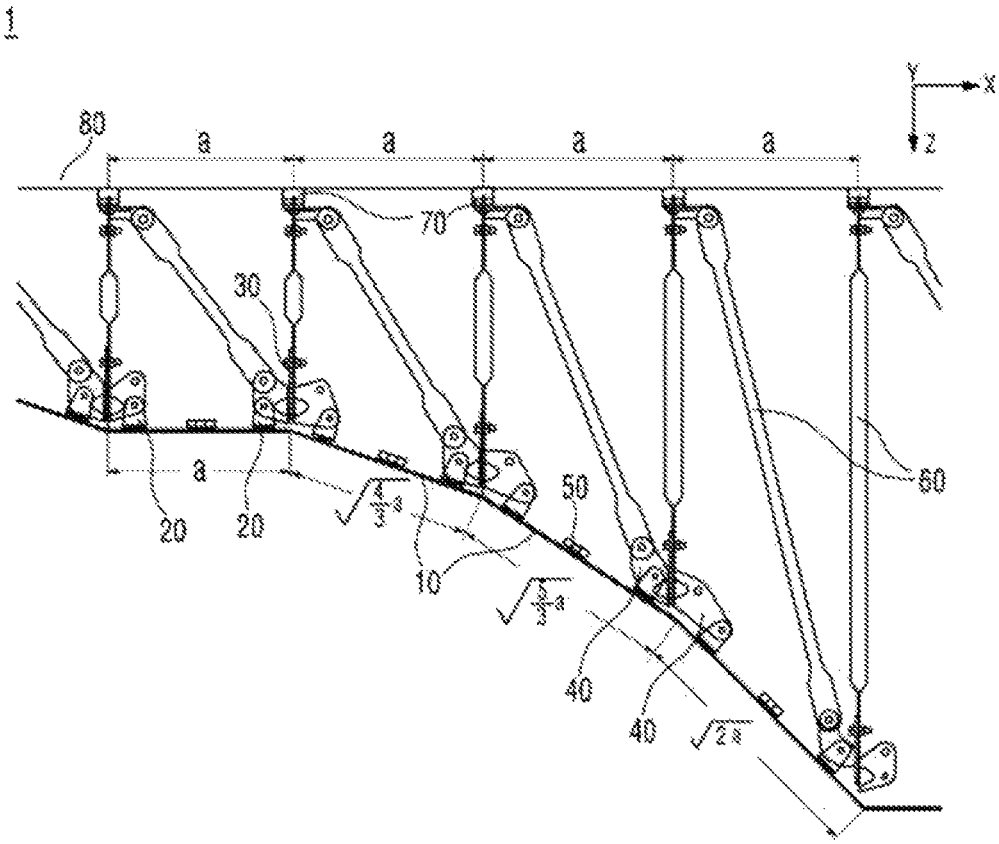
FIG. 15 is a mimetic diagram showing that adjacent artificial climbing wall panels 10 have been coupled to each other as viewed perpendicular to the XZ plane.
Figure 16:
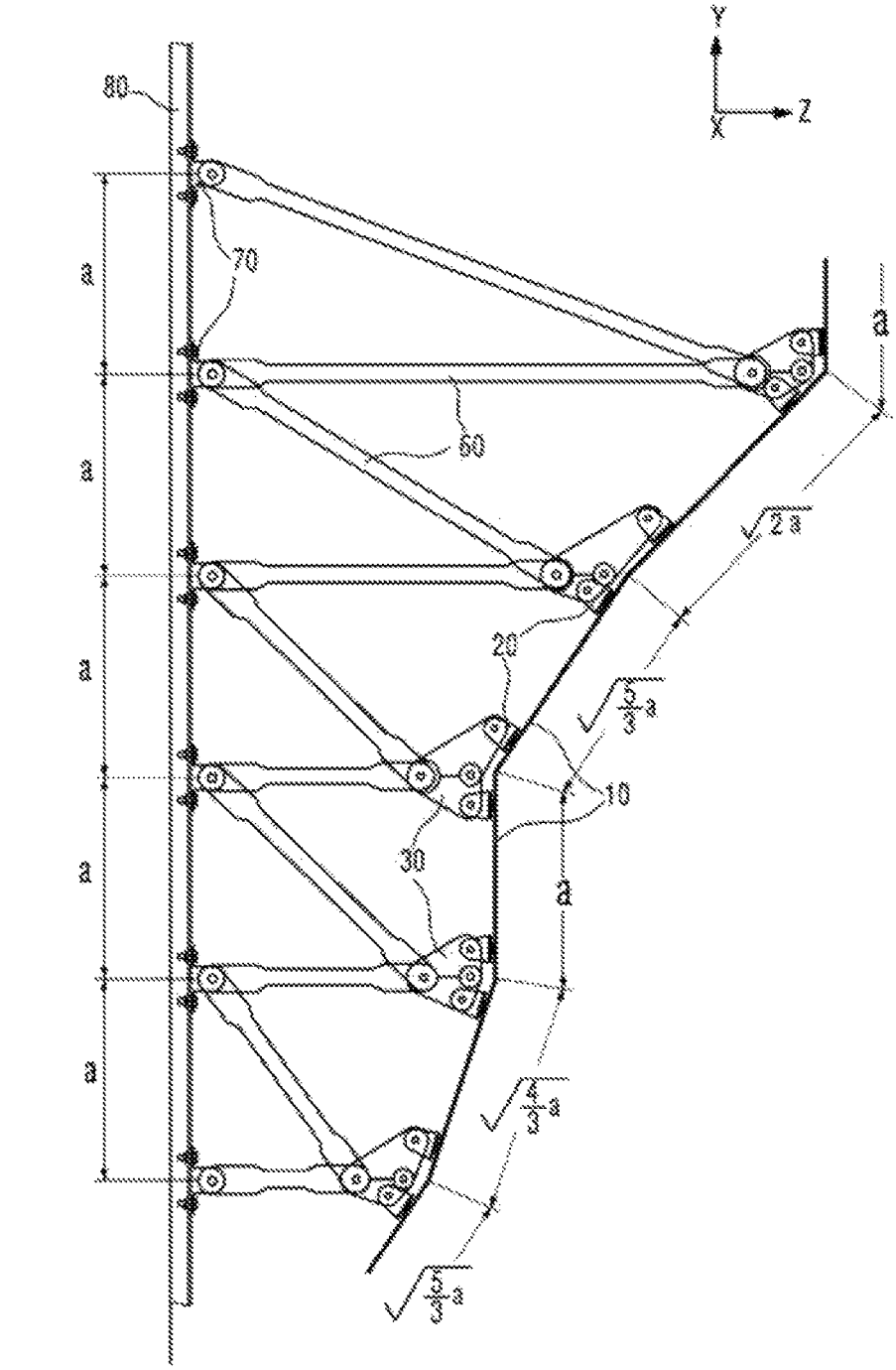
FIG. 16 is a mimetic diagram showing that adjacent artificial climbing wall panels 10 have been coupled to each other as viewed perpendicular to the YZ plane.

FIG. 5 is a perspective view of the basic bracket 20. FIG. 6 is a view showing an embodiment of the vertical bracket 30. FIG. 7 is a view showing another embodiment of the vertical bracket 30. FIG. 8 is a state diagram showing adjacent artificial climbing wall panels 10 coupled to each other by the vertical bracket 30. FIG. 9 is a front view of an embodiment of the horizontal bracket 40. FIG. 10 is a side view of the horizontal bracket 40 of FIG. 9. FIG. 11 is a front view of another embodiment of the horizontal bracket 40. FIG. 12 is a state diagram showing that adjacent artificial climbing wall panels 10 have been coupled to each other by the horizontal bracket 40. FIG. 13 is a plan view of an adjustable bracket 50. FIG. 14 is a state diagram showing that adjacent artificial climbing wall panels 10 have been coupled to each other by the adjustable bracket 50. FIG. 15 is a mimetic diagram showing that adjacent artificial climbing wall panels 10 have been coupled to each other as viewed perpendicular to the XZ plane. FIG. 16 is a mimetic diagram showing that adjacent artificial climbing wall panels 10 have been coupled to each other as viewed perpendicular to the YZ plane. Hereafter, it will be described with reference to FIGS. 1, 2 and 5 to 16 how the artificial climbing wall panel 10 is installed.

In the manufacture of the artificial climbing wall structure by coupling the conventional rectangular artificial climbing wall modules, it is difficult to correctly implement the shape of the artificial climbing wall to be formed. The reason is as follows. A conventional combination bracket is used to couple the artificial climbing wall modules. In order to couple the artificial climbing wall modules by using the conventional coupling bracket, a contact portion between the vertically adjacent artificial climbing wall modules should include a surface parallel with the wall surface on which the artificial climbing wall modules are installed. Therefore, the designed correct shape of the artificial climbing wall is not obtained and a vertical plane is produced, which is not suitable for the coupling surface of the artificial climbing wall module. Due to the existence of the vertical plane, the coupling surface of the adjacent panel is not constituted only by the inclined surface of the panel and has an inappropriate shape like stairs. However, when the triangular artificial climbing wall panels 10 of the embodiment are coupled by using the base bracket 20, the vertical bracket 30, the horizontal bracket 40 and the adjustable bracket 50, all of which will be described below, it is possible to obtain the artificial climbing wall structure 1 having a desired surface shape without such an inappropriate vertical plane.

Referring to FIGS. 1, 2 and 5, in the first and the second embodiments, each side of the triangular artificial climbing wall panel 10 includes at least one bracket coupling hole 11, 12. In the third to the eleventh embodiments, each side of the triangular artificial climbing wall panel 10 also includes at least one bracket coupling hole. The number of the bracket coupling holes of each embodiment is the same as those of others.

Based on FIG. 4, when a rectangle is formed by coupling the two triangular artificial climbing wall panels 10, there are two hypotenuses forming a diagonal line. The two hypotenuses are coupled by the adjustable bracket 50. For example, in FIG. 4, the hypotenuse of the first artificial climbing wall panel 10 from the left of the uppermost end is in contact with the hypotenuse of the artificial climbing wall panel 10 on the just right of the first artificial climbing wall panel 10. It means that the hypotenuses are coupled by the adjustable bracket 50. Also, when the other two sides other than the hypotenuse are coupled to the sides adjacent thereto, the adjustable bracket 50 can be used. In particular, when the adjustable bracket 50 is used around the central portion of each side, there is an advantage in that coupling strength of the combined sides becomes higher.

Referring to FIGS. 13 and 14, the adjustable bracket 50 includes a pin 52 and a adjustable bracket plate 51. The pin 52 is located at the central portion of the adjustable bracket 50 and allows the adjustable bracket 50 to be folded and unfolded. The adjustable bracket plate 51 extends outward in both directions of the pin 52. Holes are formed in the adjustable bracket plate 51 and are directly coupled with the artificial climbing wall panel 10. As shown in FIG. 14, since the adjustable bracket 50 is folded and unfolded, the adjustable bracket 50 can be applied to all the various angles formed by adjacent artificial climbing wall panels 10. After the artificial climbing wall panels 10 become adjacent to each other, the bracket coupling hole of the artificial climbing wall panel 10 is in alignment with the hole of the adjustable bracket 50. Subsequently, the adjacent artificial climbing wall panel 10 is coupled to the adjustable bracket 50 by using a screw or a pin. Therefore, when coupled to the artificial climbing wall panel 10, the adjustable bracket 50 does not require additional bracket. Further, since the triangular artificial climbing wall panels 10 are coupled to each other by directly contacting the sides thereof, there is no inappropriate vertical plane.

Meanwhile, the horizontal bracket 40 and the vertical bracket 30 are not directly coupled to the artificial climbing wall panel 10. After the base bracket 20 is coupled to the artificial climbing wall panel 10, the horizontal bracket 40 or the vertical bracket 30 are coupled to the base bracket 20. In addition, because not only the adjustable bracket 50 is used but also the artificial climbing wall panels 10 are coupled to each other through the combination of the base bracket 20, the vertical bracket 30 and the horizontal bracket 40, the artificial climbing wall structure 1 according to the embodiment has no inappropriate vertical plane.

The basic bracket 20 has, as shown in FIG. 5, a plate shape of which the central portion thereof is bent and of which both ends have holes. The basic bracket 20 can be formed either by bending one member or by combining two plates of which one end has holes. Further, the central portion of the basic bracket 20 is not necessarily bent at a right angle, and may be bent at either an acute angle or an obtuse angle in accordance with an angle formed by two adjacent artificial climbing wall panels 10 to be coupled thereto. Like the adjustable bracket 50, the base bracket 20 is coupled to the artificial climbing wall panel 10 by using a screw or a pin.

FIGS. 6 and 7 show two examples of the vertical bracket 30. The vertical bracket 30 basically has a shape of a triangular plate. A hole formed around one vertex of the triangle is coupled to the base bracket 20 coupled to the artificial climbing wall panel 10, and the other two vertices include holes allowing the vertical bracket 30 to be coupled to another vertical bracket 30. FIGS. 6 and 7 show that the circumference of the hole for coupling the vertical brackets 30 to each other has a circular disk shape. Here, it is recommended that the sizes and shapes of the disks corresponding to each other be the same as each other. After first disks 32 of the two vertical brackets 30 are superposed on each other and second disks 33 of the two vertical brackets 30 are superposed on each other, the two vertical brackets 30 are coupled to each other by using a screw or a pin. In this case, the coupling, strength of the two vertical brackets 30 becomes higher than that of the two vertical brackets 30 coupled only by a screw or a pin, because the load of the artificial climbing wall panel 10 is supported by not only the rigidity of the screw or the pin but also the two vertical brackets 30 themselves thanks to the structural fit of the disks.

FIG. 8 shows that two vertical brackets 30 have been coupled to each other. It can be found by those skilled in the art that when the upper artificial climbing wall panel 10 becomes more inclined to the right, the upper vertical bracket 30 should have a triangular shape of which the right vertex portion extends more to the right. On the contrary, it can be found by those skilled in the art that when the upper artificial climbing wall panel 10 becomes more inclined to the left, the upper vertical bracket 30 should have a shape similar to that of the vertical bracket 30 of FIG. 7. As can be seen referring to FIG. 8, there is no inappropriate vertical plane on a contact surface between the adjacent upper and lower artificial climbing wall panels 10 coupled to each other by using the vertical bracket 30 and the base bracket 20. The inappropriate vertical plane corresponds to, for example, not only the inclined surface but also a plane parallel with the Y-axis, which the upper artificial climbing wall panel 10 of FIG. 8 is necessary to include in order to be coupled to the bracket. FIG. 8 shows that there is no inappropriate vertical plane because the upper artificial climbing wall panel 10 has only an inclined surface.

FIGS. 9 and 11 show two examples of the horizontal bracket 40. Referring to FIGS. 9 and 11, the horizontal bracket 40 basically has a shape of a quadrangular plate. Holes are formed around both vertices of the quadrangle. A circular third disk 42 perpendicular to a horizontal bracket plate 41 is attached to a side connecting the other two vertices. The third disk 42 has a hole. After the hole of the second disk 33 which has been formed in the vertical bracket 30 in the sixth to the eighth embodiments is in alignment with the hole of the third disk 42 formed in the horizontal bracket 40, the horizontal bracket 40 and the vertical bracket 30 are coupled to each other at a time by using a screw or a pin. Consequently, the two vertical brackets 30 and the two horizontal brackets 40 are coupled to each other by passing the pin or the screw through the holes of the four disks 33, 33, 42 and 42 in all. Referring to FIGS. 9 and 10, in order to insert a screw or a pin into the hole of the third disk 42 shown in FIG. 10, there is an opening between the right end of the horizontal bracket plate 41 of FIG. 9 and the third disk 42. The third disk 42 of the horizontal bracket 40 is coupled to the second disk 33 of the vertical bracket 30. The horizontal bracket 40 is able to rotate about the screw or the pin coupling the third disk 42 with the second disk 33. The horizontal bracket 40 and the vertical bracket 30 should be tightly coupled to each other without a gap. Here, before a screw or a pin is firmly fastened and after the horizontal bracket plate 41 of the horizontal bracket 40 is maintained perpendicular to a wall 80, the screw or the pin should be firmly fastened to couple the horizontal bracket 40 to the vertical bracket 30.

Referring to FIG. 12, when the right artificial climbing wall panel 10 is more projected in the positive direction of the Z-axis or is dented in the negative direction of the Z-axis, it can be easily understood by those skilled in the art that the shape of the horizontal bracket plate 41 located on the right side of the drawing can be somewhat changed or the length of each side of the horizontal bracket plate 41 or the angle formed by sides of the horizontal bracket plate 41 can be somewhat changed.

Referring to FIG. 15, the uppermost line of FIG. 15 is a wall surface 80 on which the artificial climbing wall structure 1 is installed. That is, FIG. 15 shows a cross section formed by cutting the artificial climbing wall structure 1 along the XZ plane. The leftmost line of FIG. 16 is the wall surface 80 on which the artificial climbing wall structure 1 is installed. That is, FIG. 16 shows a cross section formed by cutting the artificial climbing wall structure 1 along the YZ plane. FIG. 16 shows how the vertical bracket 30, shown in FIG. 8 connects the wall surface 80 with the artificial climbing wall panel 10 in the artificial climbing wall structure 1. An anchor 70 is embedded in the wall surface. The anchor 70 and the vertical bracket 30 are mechanically connected with each other and supported by a tubing 60. FIG. 15 shows how the horizontal bracket 40 shown in FIG. 12 connects the wall surface 80 with the artificial climbing wall panel 10 in the artificial climbing wall structure 1. The horizontal bracket 40 and the anchor 70 embedded in the wall surface 80 which has been already described in FIG. 15 are mechanically connected with each other and supported by the tubing 60. The tubing 60 is generally used to form a frame of a large structure. The tubing 60 commonly corresponds to a construction member formed by compressing both open ends of an open end pipe flat and then by forming holes in the flat ends. The anchor 70 and the tubing 60 are coupled by using a screw or a pin. The bracket and the tubing 60 are also coupled by using a screw or a pin.

As described above, since the horizontal bracket plate 41 of the horizontal bracket 40 is located on the XZ plane, that is, is always disposed perpendicular to the wall surface, the tubing 60 is always located on the XZ plane between the horizontal bracket 40 and the anchor 70 as shown in FIG. 15. Therefore, the tubing 60 connected to the horizontal bracket 40 is always disposed perpendicular to the wall surface 80. As a result, it is possible to obtain structural strength, is easy to install the tubing 60 and is convenient to maintain the artificial climbing wall structure 1 as compared with a case where the tubing 60 is installed at random without a certain pattern.

The features, structures and effects and the like described in the embodiments can be combined or modified in other embodiments by those skilled in the art to which the embodiments belong. Therefore, contents related to the combination and modification should be construed to be included in the scope of the present invention.

Although embodiments of the present invention were described above, theses are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. An artificial climbing wall structure comprises:

a plurality of square unit modules;

a plurality of base brackets;

a plurality of horizontal brackets;

a plurality of vertical brackets; and a plurality of adjustable brackets, wherein each square unit module comprises two triangular artificial climbing wall panels, wherein a longest side of one triangular artificial climbing wall panel is in contact with a longest side of another triangular artificial climbing wall panel adjacent to the one triangular artificial climbing wall panel, and wherein four sides except the two longest sides out of six sides of the two triangular artificial climbing wall panels form a rectangle as viewed perpendicular to a horizontal plane, wherein each side of the triangular artificial climbing wall panel includes at least one bracket coupling hole, wherein one of the base brackets and one of the adjustable brackets are coupled to the at least one bracket coupling hole on one side of one of the triangular artificial climbing wall panels, wherein each side of one square unit module is coupled to a side of other square unit modules by using a combination of the adjustable brackets, the base brackets, the vertical brackets, and the horizontal brackets.

2. The artificial climbing wall structure of claim 1, wherein each side of the triangular artificial climbing wall panel includes three bracket coupling holes.

3. The artificial climbing wall structure of claim 2, wherein three bracket coupling holes are positioned at central portion and two end points of side, respectively.

4. The artificial climbing wall structure of claim 1, wherein the rectangle is a square.

5. The artificial climbing wall structure of claim 1, wherein the one artificial climbing wall panel and the another artificial climbing wall panel adjacent to the one artificial climbing wall panel are coupled to each other by the base bracket and the horizontal bracket.

6. The artificial climbing wall structure of claim 1, wherein the one artificial climbing wall panel and the another artificial climbing wall panel adjacent to the one artificial climbing wall panel are coupled to each other by the base bracket and the vertical bracket.

7. The artificial climbing wall structure of claim 1, wherein the one artificial climbing wall panel and the another artificial climbing wall panel adjacent to the one artificial climbing wall panel are coupled to each other by the adjustable bracket.

8. The artificial climbing wall structure of claim 1, wherein the two contacting sides of the two triangular artificial climbing walls are connected with each other without a height difference or a level difference.

9. The artificial climbing wall structure of claim 1, wherein the adjustable bracket comprises a pin being located at the central portion thereof and allowing the bracket to be folded and unfolded, and a plate extending outward in both directions of the pin, wherein holes are formed in the plate and are directly coupled with the artificial climbing wall panel.

10. The artificial climbing wall structure of claim 1, wherein the vertical bracket has a triangular plate shape and disks including holes which are formed around the two vertices of one side of the triangular plate shape and allow the bracket to be coupled to another bracket.

11. The artificial climbing wall structure of claim 1, wherein the horizontal bracket has a quadrangular plate shape and holes formed around both vertices of the quadrangular plate shape, wherein a circular third disk which is perpendicular to the plate and has a hole formed therein is attached to a side connecting, the other two vertices.

12. The artificial climbing wall structure of claim 1, wherein the artificial climbing wall structure is installed on a wall surface by using a tubing and an anchor.

13. An artificial climbing wall structure comprises;

a plurality of square unit modules;

a plurality of base brackets;

a plurality of horizontal brackets;

a plurality of vertical brackets; and a plurality of adjustable brackets, wherein each square unit module comprises two triangular artificial climbing wall panel, wherein a longest side of one triangular artificial climbing wall panel is in contact with a longest side of another triangular artificial climbing wall panel adjacent to the one triangular artificial climbing wall panel, and wherein Z-components of vertices of both ends of the longest sides are equal to each other;

wherein each side of the triangular artificial climbing wall panel includes at least one bracket coupling hole, wherein one of the base brackets and one of the adjustable brackets are coupled to the at least one bracket coupling hole on one side of one of the triangular artificial climbing wall panels, wherein each side of one square unit module is coupled to a side of other square unit modules by using a combination of the adjustable brackets, the base brackets, the vertical brackets, and the horizontal brackets.

14. The artificial climbing wall structure of claim 13, wherein the one artificial climbing wall panel and the another artificial climbing wall panel adjacent to the one artificial climbing wall panel are coupled to each other by at least one of the horizontal bracket, the vertical bracket and the adjustable bracket.

15. The artificial climbing wall structure of claim 13, wherein the one artificial climbing wall panel and the another artificial climbing wall panel adjacent to the one artificial climbing wall panel are coupled to each other by the base bracket and the horizontal bracket.

16. The artificial climbing, wall structure of claim 13, wherein the one artificial climbing wall panel and the another artificial climbing wall panel adjacent to the one artificial climbing wall panel are coupled to each other by the base bracket and the vertical bracket.

17. The artificial climbing wall structure of claim 13, wherein the one artificial climbing wall panel and the another artificial climbing wall panel adjacent to the one artificial climbing wall panel are coupled to each other by the adjustable bracket.

18. The artificial climbing wall structure of claim 13, wherein the adjustable bracket comprises a pin being located at the central portion thereof and allowing the bracket to be folded and unfolded, and a plate extending outward in both directions of the pin, wherein holes are formed in the plate and are directly coupled with the artificial climbing wall panel.

19. The artificial climbing wall structure of claim 13, wherein the vertical bracket has a triangular plate shape and disks including holes which are formed around the two vertices of one side of the triangular plate shape and allow the bracket to be coupled to another bracket.

20. The artificial climbing wall structure of claim 13, wherein the horizontal bracket has a quadrangular plate shape and holes formed around both vertices of the quadrangular plate shape, wherein a circular third disk which is perpendicular to the plate and has a hole formed therein is attached to a side connecting the other two vertices.

* * * * *